US006524464B2

(12) United States Patent
Dubey, Jr.

(10) Patent No.: US 6,524,464 B2
(45) Date of Patent: Feb. 25, 2003

(54) FAN FLOW SENSOR FOR HYDROGEN GENERATING PROTON EXCHANGE MEMBER ELECTROLYSIS CELL

(75) Inventor: Richard A. Dubey, Jr., Torrington, CT (US)

(73) Assignee: Proton Energy Systems, Inc., Rocky Hill, CT (US)

( * ) Notice: Subject to any disclaimer, the term of this patent is extended or adjusted under 35 U.S.C. 154(b) by 0 days.

(21) Appl. No.: 09/842,617

(22) Filed: Apr. 25, 2001

(65) Prior Publication Data

US 2002/0157942 A1 Oct. 31, 2002

(51) Int. Cl.[7] ..... C25B 15/02; C25C 1/00

(52) U.S. Cl. ..... 205/335; 204/228.1; 204/228.3; 204/228.5

(58) Field of Search ..... 205/335, 628, 205/633, 637; 422/22; 204/228.1, 228.3, 228.5

(56) References Cited

U.S. PATENT DOCUMENTS

| | | | | | |
|---|---|---|---|---|---|
| 4,788,389 | A | * | 11/1988 | Okazaki | 200/307 |
| 5,736,016 | A | * | 4/1998 | Allen | 204/237 |
| 5,783,060 | A | * | 7/1998 | La Riviere et al. | 205/337 |
| 5,980,726 | A | | 11/1999 | Moulthrop, Jr. et al. | 205/637 |
| 6,022,459 | A | * | 2/2000 | Briggs | 204/228.4 |
| 6,033,549 | A | * | 3/2000 | Peinecke et al. | 205/335 |

* cited by examiner

*Primary Examiner*—Nam Nguyen
*Assistant Examiner*—Wesley A. Nicolas
(74) *Attorney, Agent, or Firm*—Cantor Colburn LLP

(57) ABSTRACT

A fan flow sensor for a hydrogen generating proton exchange member electrolysis cell includes a switching device and a sail slideably disposed on the switching device. The sail is configured to actuate the switching device in response to an airflow from a fan. The switching device may be actuatable in response to a magnet disposed on the sail.

4 Claims, 5 Drawing Sheets

FAN FLOW SENSOR FOR HYDROGEN GENERATING PROTON EXCHANGE MEMBER ELECTROLYSIS CELL

BACKGROUND

Electrochemical cells are energy conversion devices that are usually classified as either electrolysis cells or fuel cells. Proton exchange membrane electrolysis cells function as hydrogen generators by electrolytically decomposing water to produce hydrogen and oxygen gases. The hydrogen gas is then removed and used as a fuel. Referring to FIG. 1, a section of an anode feed electrolysis cell of the related art is shown generally at 10 and is hereinafter referred to as "cell 10." Reactant water 12 is fed into cell 10 at an oxygen electrode (anode) 14 to form oxygen gas 16, electrons, and hydrogen ions (protons). The chemical reaction is facilitated by the positive terminal of a power source 18 connected to anode 14 and a negative terminal of power source 18 connected to a hydrogen electrode (cathode) 20. Oxygen gas 16 and a first portion 22 of the water are discharged from cell 10, while the protons and a second portion 24 of the water migrate across a proton exchange membrane 26 to cathode 20. At cathode 20, hydrogen gas 28 is formed and is removed for use as a fuel. Second portion 24 of water, which is entrained with hydrogen gas, is also removed from cathode 20. The removal of hydrogen is generally effectuated through a gas delivery line.

Cell 10 includes a number of individual cells (not shown) arranged in a stack with reactant water 12 being directed through the cells via input and output conduits formed within the stack structure. The cells within the stack are sequentially arranged, and each one includes a membrane electrode assembly defined by a proton exchange membrane disposed between a cathode portion and an anode portion. The cathode portion, anode portion, or both may be gas diffusion electrodes that facilitate gas diffusion to the proton exchange membrane. Each membrane electrode assembly is supported on both sides by screen packs within flow fields. The screen packs facilitate fluid movement and membrane hydration and provide mechanical support for the membrane electrode assembly.

Power to the electrolysis cell is interrupted when, after sensing a condition such as a pressure variation in the gas delivery line, a control unit signals an electrical source that drives a reference voltage applied across a potentiometer to an extreme value. In such a system, the control unit is directly dependent upon the detection of a mass leak from the gas delivery line. Depending upon the preselected conditions of the system, when the power interruption capability is dependent upon the detection of a mass leak, a delay between the time that the leak occurs and the time at which the system is shut down may be experienced. Such systems do not provide early detection of potential problems but instead simply react to signals indicative of problems currently existing in the operation of the cell.

SUMMARY

A fan flow sensor for a hydrogen generating proton exchange member electrolysis cell is disclosed herein. The fan flow sensor includes a switching device and a sail slideably disposed on the switching device. The sail is configured to actuate the switching device in response to an airflow from a fan.

DETAILED DESCRIPTION

Figure 2:
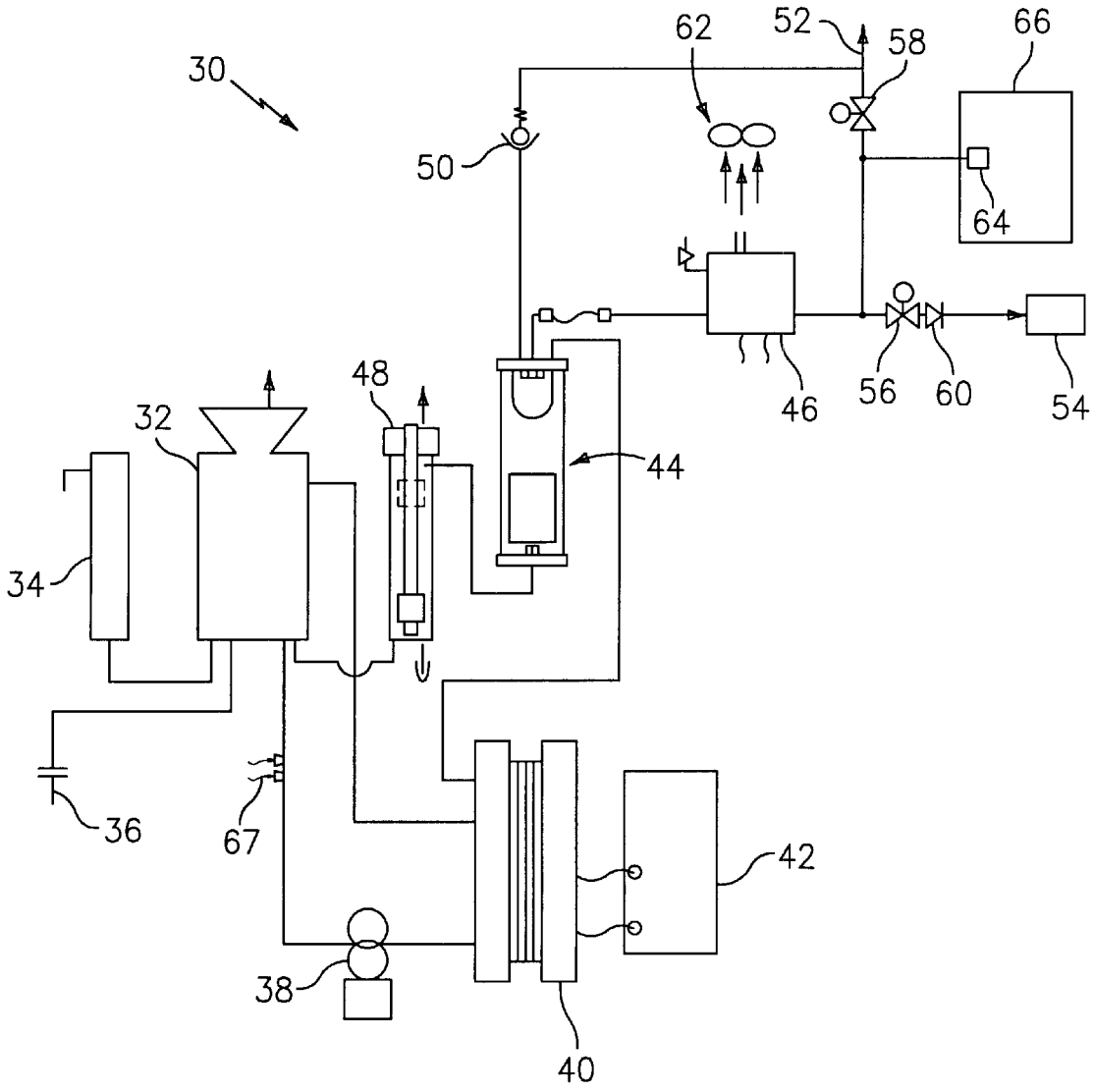
FIG. 2 is a schematic representation of a gas generating apparatus into which an electrolysis cell may be incorporated.

Referring to FIG. 2, an exemplary embodiment of a gas generating apparatus incorporating a proton exchange membrane electrolysis cell is shown generally at 30 and is hereinafter referred to as "generator 30." Generator 30 is suitable for generating hydrogen for use in gas chromatography, as a fuel, and for various other applications. It is to be understood that while the inventive improvements described below are described in relation to an electrolysis cell, the improvements are generally applicable to both electrolysis and fuel cells. Furthermore, although the description and figures are directed to the production of hydrogen and oxygen gas by the electrolysis of water, the apparatus is applicable to the generation of other gases from other reactant materials.

Figure 1:
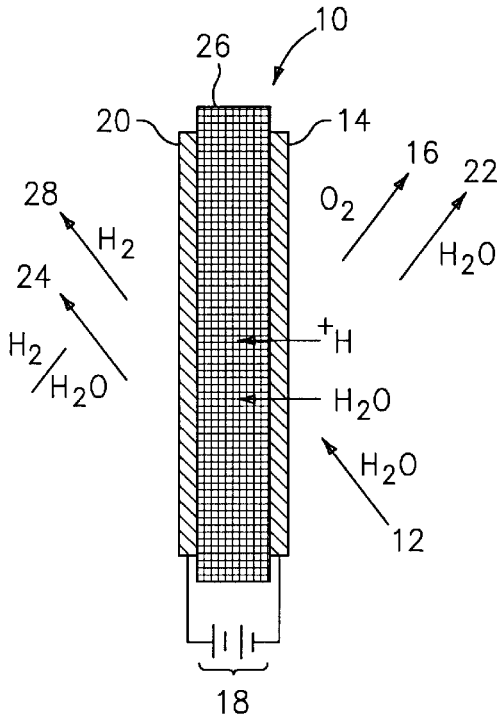
FIG. 1 (PRIOR ART)
FIG. 1 is a schematic representation of an anode feed electrolysis cell of the related art.

Generator 30 includes a water-fed electrolysis cell capable of generating gas from reactant water and is operatively coupled to a control system. Suitable reactant water is deionized distilled water and is continuously supplied from a water source 32 having a level indicator 34 and a drain 36 operatively included therewith. The reactant water is pumped through a pump 38 into an electrolysis cell stack 40. Cell stack 40 comprises a plurality of cells similar to cell 10 described above with reference to FIG. 1 encapsulated within sealed structures (not shown). The reactant water is received by manifolds or other types of conduits (not shown) that are in fluid communication with the cell components. An electrical source 42 is connected across the anodes and cathodes of each cell within cell stack 40 to allow the water to disassociate.

Oxygen and water exit cell stack 40 via a common stream and are ultimately returned to water source 32, whereby the water is recycled and the oxygen is vented to the atmosphere. The hydrogen stream, which contains water, exits cell stack 40 and is fed to a phase separation tank, which is a hydrogen/water separation apparatus 44, hereinafter referred to as "separator 44," where the gas and liquid phases are separated. This hydrogen stream has a pressure that is generally about 250 pounds per square inch (psi), but which may be anywhere from about 1 psi up to about 6000 psi. Some water is removed from the hydrogen stream at separator 44. The exiting hydrogen gas (having a lower water content than the hydrogen stream to separator 44) is further dried at 46, for example by a diffuser, a pressure swing absorber, or a dessicant. The removed water with trace amounts of hydrogen entrained therein may be returned to water source 32 through a low pressure hydrogen separator 48. Low pressure hydrogen separator 48 allows hydrogen to escape from the water stream due to the reduced pressure, and also recycles water to water source 32 at a lower pressure than the water exiting separator 44. Separator 44 may also include a release 50, which may be a relief valve, to rapidly purge hydrogen to a hydrogen vent 52 when the pressure or pressure differential exceeds a preselected limit.

Pure hydrogen from dryer 46 is fed to a hydrogen storage 54. Valves 56, 58 may be provided at various points on the system lines and may be configured to release hydrogen to vent 52 under certain conditions. Furthermore, a check valve 60 is provided that prevents the backflow of hydrogen to dryer 46 and separator 44.

A ventilation system, shown generally at 62, is provided to assist in venting system gases when necessary. Ventilation system 62 comprises a fan portion that continually purges the air in the enclosure of generator 30. An airflow switch is mounted on the fan portion and is configured to interrupt the power to cell stack 40 in the event of a failure in the fan portion, thereby halting the production of hydrogen gas.

A hydrogen output sensor 64 is incorporated into generator 30. Hydrogen output sensor 64 may be a pressure transducer that converts the gas pressure within the hydrogen line to a voltage or current value for measurement. However, hydrogen output sensor 64 can be any suitable output sensor other than a pressure transducer, including, but not limited to, a flow rate sensor, a mass flow sensor, or any other quantitative sensing device. Hydrogen output sensor 64 is interfaced with a control unit 66, which is capable of converting the voltage or current value into a pressure reading. Furthermore, a display means (not shown) may be disposed in operable communication with hydrogen output sensor 64 to provide a reading of the pressure, for example, at the location of hydrogen output sensor 64 on the hydrogen line. Control unit 66 may be any suitable gas output controller, such as an analog circuit or a digital microprocessor.

Water source 32 provides the fuel for generator 30 by supplying the reactant water to the system. The reactant water utilized by generator 30 is stored in water source 32 and is fed by gravity or pumped through a supply line into cell stack 40. The supply line is preferably clear unplasticized polyvinyl chloride (PVC) hose. An electrical conductivity sensor 67 may be disposed within the supply line to monitor the electrical potential of the water, thereby determining its purity and ensuring its adequacy for use in generator 30.

Figure 3:
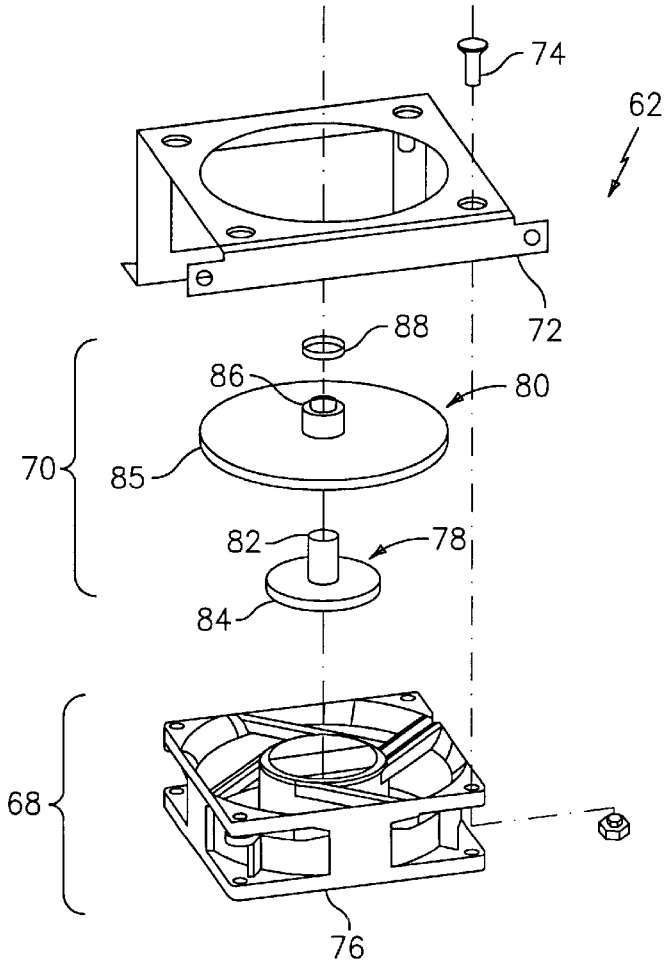
FIG. 3 is an exploded perspective view of a ventilation system of a gas generating apparatus.
Figure 4:
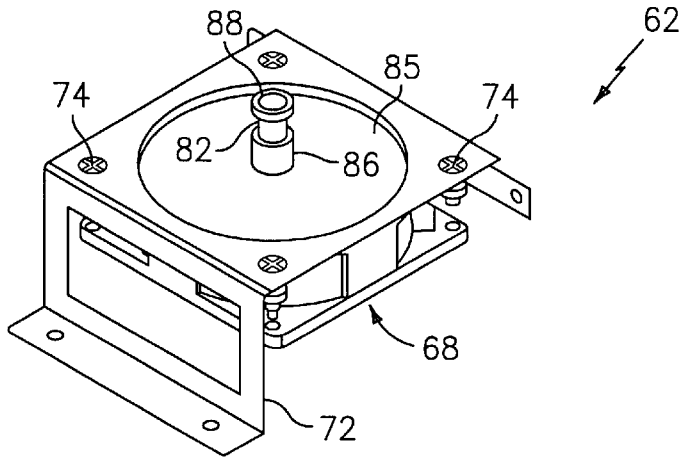
FIG. 4 is a perspective view of a ventilation system of a gas generating apparatus.

Referring now to FIGS. 3 and 4, ventilation system 62 is shown in greater detail. Ventilation system 62 comprises a fan portion, shown generally at 68, and a fan flow sensor portion, shown generally at 70, disposed in operable communication with fan portion 68. Fan portion 68 and fan flow sensor portion 70 are mounted within the generator with a bracket 72. Fasteners 74 extending through bracket 72 enable fan portion 68 to be secured to bracket 72. Fan portion 68 comprises an impeller (not shown) rotatably mounted within a housing 76 and driven by a motor (not shown), which may be a 12 volt DC motor. The impeller provides ventilation within the enclosure of the generator via a continual purge of air at a rate such that if the full production of hydrogen were to leak into the enclosure, the hydrogen would be vented outside the enclosure and diluted to a very low concentration.

Fan flow sensor portion 70 comprises an airflow switch, shown generally at 78, and a sail/collar assembly, shown generally at 80, in operable communication with airflow switch 78. Sail/collar assembly 80 is configured to receive airflow from fan portion 68. Airflow switch 78 is defined by a switching device mounted in a spindle 82 extending from an upper surface of a base member 84. Sail/collar assembly 80 is defined by a substantially planar sail 85 having a collar 86 extending either from an upper surface of sail 85 as shown or through the upper surface and a lower surface of sail 85. Collar 86 is received over spindle 82 such that slideable communication is maintained therebetween. A retainer 88 is disposed at an upper end of spindle 82 distal from base member 84.

Figure 5A:
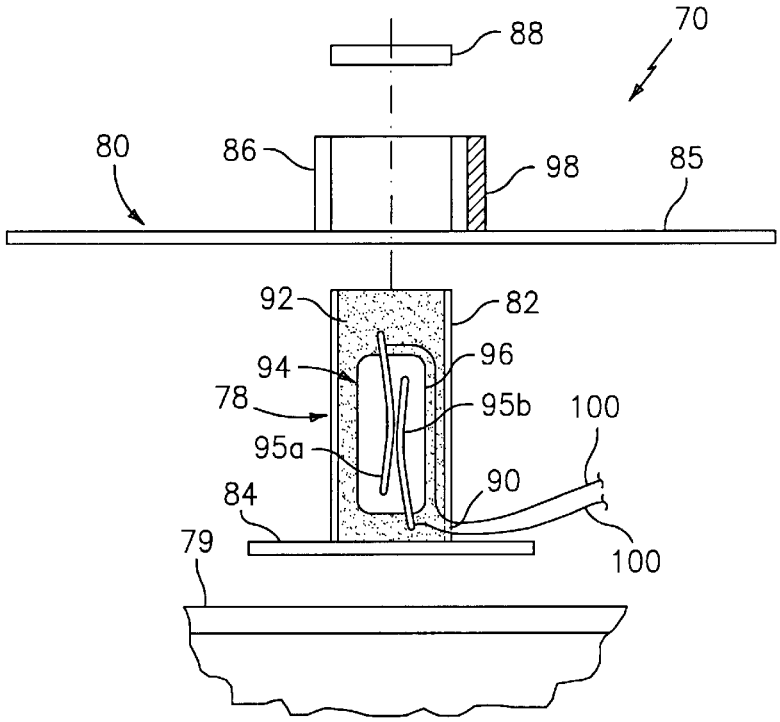
FIGS. 5A and 5B are exploded sectional views of sail/collar assemblies.
Figure 5B:
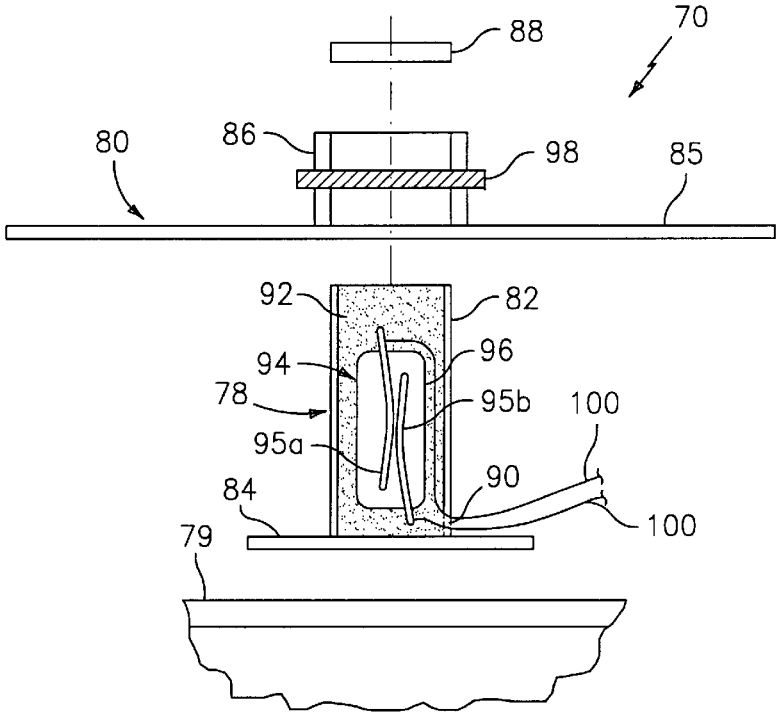

In FIGS. 5A and 5B, fan flow sensor portion 70, particularly airflow switch 78 and sail/collar assembly 80, are shown in greater detail. Airflow switch 78 is configured to function independent from the delivery line pressure of the hydrogen gas. In airflow switch 78, spindle 82 is fixedly mounted to base member 84 at a lower end thereof such that spindle 82 extends substantially perpendicularly from the upper surface of base member 84. Alternately, spindle 82 and base member 84 may be cast as a unitary piece. An opening 90 is formed within spindle 82 and extends therethrough to enable communication to be maintained between the switching device inside spindle 82 and a ventilation system control unit (not shown) remotely located from spindle 82. The switching device is securely disposed within spindle 82 with a potting material 92. Potting material 92 provides a relief to stresses associated with the operation of airflow switch 78 and is generally a solidified material such as an epoxy. An adhesive (not shown) may be applied to a lower surface of base member 84 to facilitate the attachment of airflow switch 78 to a hub 79 of the fan portion.

The switching device is a reed switch and is shown generally at 94. Reed switch 94 includes two separate flexible magnetic reeds 95*a*, 95*b* disposed adjacent to each other within an enclosure 96. Enclosure 96 is centered within potting material 92. The flexibility of reeds 95*a*, 95*b* enables reeds 95*a*, 95*b* to be magnetically biased together such that contact can be intermittently made therebetween and maintained upon the magnetic actuation of reed switch 94, which is effectuated by the placement of a magnet 98 in close proximity to reeds 95*a*, 95*b*. In FIG. 5A, magnet 98 is shown as a bar magnet disposed longitudinally along the length of collar 86. In FIG. 5B, magnet 98 is shown as a ring magnet disposed around collar 86. In either configuration, lead wires 100 extend from each reed 95*a*, 95*b* through potting material 92 and through opening 90 to provide electronic communication between reed switch 94 and the ventilation system control unit.

With respect to sail/collar assembly 80, collar 86 functions as a guide member to provide for the translational motion of sail 85 along spindle 82. Collar 86 is configured to be received over spindle 82 such that sail/collar assembly 80 is slideably disposed on spindle 82. Regardless of whether magnet 98 is a bar magnet, as is shown in FIG. 5A, or a ring magnet, as is shown in FIG. 5B, magnet 98 is disposed on the outer surface of collar 86; alternately, magnet 98 may be insert-molded directly into collar 86. Magnet 98 is generally fabricated from a rare earth element such as neodymium. Both collar 86 and spindle 82 are radially dimensioned relative to each other to facilitate such slideable motion with a minimum amount of resistance generated by the contact of the outer surface of spindle 82 and the inner surface of collar 86. Both collar 86 and spindle 82 are likewise axially dimensioned relative to each other such that collar 86 can axially translate the length of spindle 82 to a point where reed switch 94 is unaffected by magnet 98.

Sail 85 is fixedly mounted to a lower end of collar 86. Alternately, sail 85 can be integrally formed with collar 86, e.g., collar 86 can be formed or molded with sail 85 such that sail/collar assembly 80 is a unitary piece. The dimensions of sail 85 substantially correspond with the dimensions of the opening in the fan portion through which airflow is generated by the rotation of the impeller. In particular, because the shape of the opening in the fan portion is generally circular, sail 85 is generally circular. Materials that may be used for the construction of sail 85 (and also for the construction of collar 86) include, but are not limited to, titanium, aluminum, high density polypropylene, polytetrafluoroethylene, nylon, and MYLAR.

Retainer 88 is a ring-shaped element dimensioned to be positioned over the upper end of spindle 82 and fixedly attached thereto. Retainer 88 prevents the axial translation of sail/collar assembly 80 beyond the upper end of spindle 82 and, more particularly, prevents the removal of sail/collar assembly 80 from spindle 82 altogether.

Figure 6:
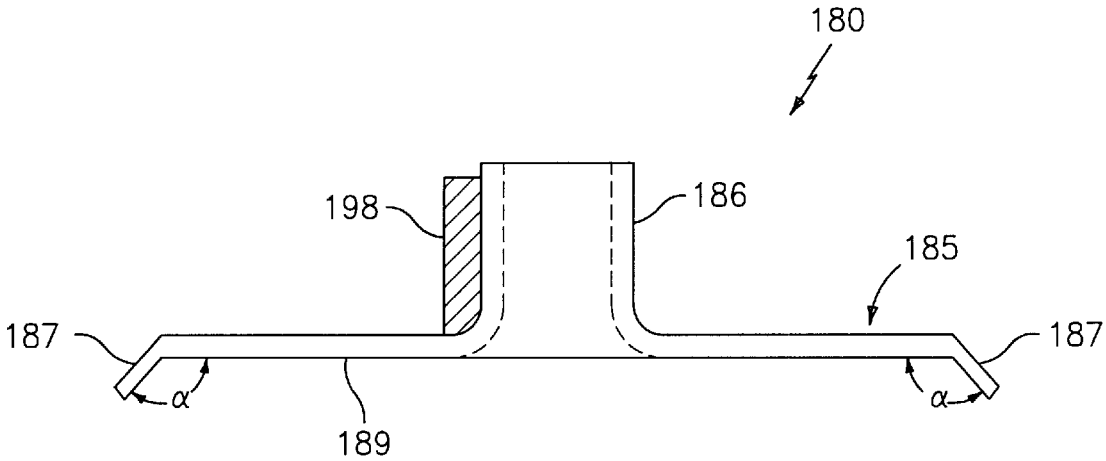
FIG. 6 is an alternate configuration of a sail/collar assembly.

Referring now to FIG. 6, another configuration of a sail/collar assembly is shown generally at 180. Sail/collar assembly 180 comprises a collar 186 and an associated magnet 198 similar to those described with reference to FIGS. 3, 4, 5A, and 5B. Sail/collar assembly 180 further comprises a sail, shown generally at 185, having a deflective surface 187 disposed about the periphery of sail 185. Deflective surface 187 is dimensioned to be angled away from a flat planar surface 189 of sail 185 at an angle $\alpha$, which is generally between about five and ten degrees. By incorporating deflective surface 187 into the architecture of sail 185, sail/collar assembly 180 can experience additional lift as a result of airflow from the fan portion.

Figure 7A:
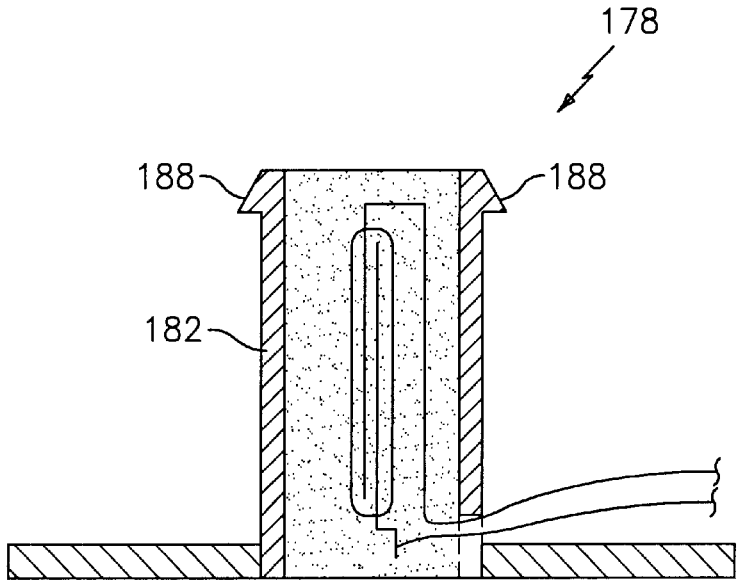
FIGS. 7A and 7B are alternate configurations of retainers disposed on spindles.
Figure 7B:
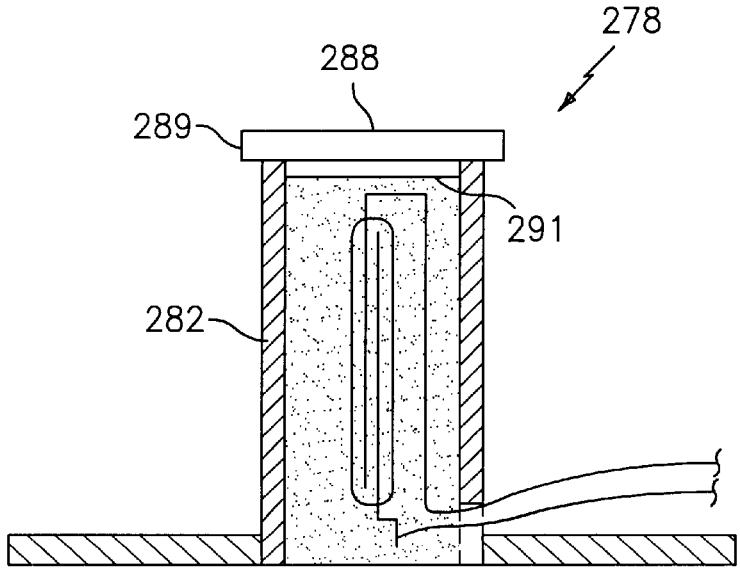

Referring now to FIGS. 7A and 7B, additional configurations of airflow switches are shown. In an airflow switch shown generally at 178 in FIG. 7A, the retainer (as illustrated at 88 in FIGS. 3, 4, 5A, and 5B) can be reconfigured to define tabs 188 fixedly disposed on and extending laterally from the upper end of a spindle 182. Tabs 188 comprise protrusions extending normally from the surface of a spindle 182 to prevent the axial translation of a sail/collar assembly (not shown) beyond the upper end of spindle 182. Tabs 188 are, furthermore, flexible to allow the sail/collar assembly to be "snapped" onto spindle 182. Although two tabs 188 are illustrated, any number of tabs 188 can be disposed peripherally about the cross section of the upper end of spindle 182 to retain the sail/collar assembly thereon.

In an airflow switch shown generally at 278 in FIG. 7B, a retainer 288 is configured as a plug having a lip 289 and a plug portion 291. Once the sail/collar assembly (not shown) is inserted onto a spindle 282, plug portion 291 is inserted into an upper open end of a spindle 282. Lip 289 is dimensioned to overhang the outer perimeter of spindle 282, thereby retaining the sail/collar assembly thereon.

The operation of fan flow sensor portion 70 is described with reference to FIGS. 3, 5A, and 5B. The slideable communication maintained between sail/collar assembly 80 and spindle 82 provides for the actuation of airflow switch 78. Airflow switch 78 is electronically configured to interrupt the flow of electrical current to the cell stack in the event that the airflow generated by the impeller of fan portion 68 is impeded to any degree as a result of operational difficulties. At startup of the generator, sail/collar assembly 80 rests on spindle 82 adjacent base member 84. Magnet 98 provides communication between reeds 95*a*, 95*b* of reed switch 94 by causing reeds 95*a*, 95*b* to flex and remain in contact with each other. The contact maintained between reeds 95*a*, 95*b* closes a circuit, thereby causing electronic communication to be maintained between reed switch 94 and the ventilation system control unit through lead wires 100. Upon rotation of the impeller, airflow is generated through fan portion 68, which causes sail 85 to slide via collar 86 up spindle 82 and lift away from base member 84. Upon proper functioning of fan portion 68, the lift experienced by sail 85 causes magnet 98 to be removed from the proximity of reed switch 94. Reeds 95*a*, 95*b* then relax and separate, thereby interrupting the continuity of the circuit and removing the signal to the cell stack that causes the interruption of power.

In order for the generator to be shut down during its operation, only ventilation system 62 needs to malfunction. By configuring the system such that the interruption of power thereto is dependent upon the proper functioning of ventilation system 62 instead of the pressure delivery line, the cell stack can be shut down upon obstruction of fan portion 68 (or a similar problem) prior to any leakages of hydrogen gas. The cell stack and all of its associated components except for ventilation system 62 may, therefore, be in functioning order during the operation of the generator. Nevertheless, because ventilation system 62 operates independent of the delivery line pressure, malfunction or failure of either fan portion 68 or airflow switch 78 will close the circuit and cause a signal to be sent to the electrical source to interrupt the flow of electrical current to the cell stack, thereby shutting down operation of the generator.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method of controlling the operation of an electrolysis cell said method comprising:

generating an airflow at a sail of a ventilation system disposed in operable communication with a switch, wherein said switch is in operable communication with said electrolysis cell;

translating said sail in response to said airflow;

actuating said switch in response to said translating of said sail; and breaking the continuity of an electrical communication between said switch and said electrolysis cell upon impeding of said airflow to discontinue operation of said electrolysis cell.

2. The method of claim 1, wherein said breaking of the continuity further comprises interrupting a signal to said electrolysis cell.

3. The method of claim 2, wherein said breaking of the continuity of the electrical communication further comprises separating reeds of a magnetically actuatable reed switch.

4. The method of claim 1, wherein said translating of said sail further comprises causing said sail to slide along a collar in response to said airflow.

* * * * *